United States Patent [19]

Dorrepaal et al.

[11] 4,171,261

[45] Oct. 16, 1979

[54] PROCESS FOR THE FLOTATION OF ORES AND COLLECTOR FOR USE IN THIS PROCESS

[75] Inventors: Wim Dorrepaal; Gerardus M. van den Haak, both of Bodegraven; Joseph M. Weehuizen, Oegstgeest; Johan G. Aalbers, Bodegraven, all of Netherlands

[73] Assignee: Chem-Y, Fabriek van Chemische Produkten B.V., Bodegraven, Netherlands

[21] Appl. No.: 740,078

[22] Filed: Nov. 8, 1976

[30] Foreign Application Priority Data

Nov. 11, 1975 [GB] United Kingdom ..... 46601/75

[51] Int. Cl.[2] ..... B03D 1/02

[52] U.S. Cl. ..... 209/166; 252/61

[58] Field of Search ..... 209/166; 252/61

[56] References Cited

FOREIGN PATENT DOCUMENTS 142232 3/1961 U.S.S.R. ..... 252/61

143745 7/1961 U.S.S.R. ..... 209/106

*Primary Examiner*—Robert Halper

*Attorney, Agent, or Firm*—Browdy and Neimark

[57] ABSTRACT

A process is provided for the flotation of ores, wherein compounds of the formula $RO\text{-}(C_xH_{2x}O)_nCH_2COOM$, wherein R is an aliphatic residue of 8–18 carbon atoms or an alkylaryl residue having 6–12 carbon atoms in the alkyl moiety, n has an average value of 0–10 and x has a value of 2 or 3, and M is a monovalent cation, are used as collectors, together with the usual fatty acid type collectors, these collector mixtures possessing synergistic properties. Also collector mixtures for use in such a process are provided.

4 Claims, No Drawings

PROCESS FOR THE FLOTATION OF ORES AND COLLECTOR FOR USE IN THIS PROCESS

BACKGROUND OF THE INVENTION

1. Field of the Invention

The present invention relates to the flotation of ores, particularly to the flotation of minerals containing alkaline earth metal ions and oxidic copper and iron minerals, and more specifically to the use of certain synergistic mixtures of carboxylic acid compounds as collectors.

2. Description of the Prior Art

According to U.K. Pat. No. 1,355,091 a group of carboxylic acid derivatives containing a hydrophobic residue and having surfactant properties can be used as collectors for the flotation of various valuable constituents from ores. Although in many situations highly satisfactory results can be obtained with collectors of this large group of compounds, they have the common property that they possess a relatively strong tendency to foaming. This often causes an unfavorable influence on the desired separation during the flotation. Excessive frothing is a highly undesirable property in flotation practice. It results mostly into lower selectivities because gangue minerals are trapped in the tight froth structure. It is because of this difficulty that the superior activity and chemical selectivity of these compounds, compared with the usual fatty acid type collectors, cannot be utilized in practice to such an extent as would be desirable.

The collectors of the fatty acid type are old and well-known. These collectors usually contain oleic acid and are often called "oleic acid", even though some of the commercial collectors may only contain minor amounts of this particular acid. Of course, one will preferably use cheap materials for this purpose so that sure oleic acid is never used. Some usual materials are commercial oleic acid, oleic acid-containing wastes, fatty acids from tall oil, fatty acids from fish oils and the like. In the present specification and appending claims these materials will be called either "fatty acid type collectors", or "oleic acid-containing fatty acid type collectors", or simply "oleic acid".

THE INVENTION

An object of the invention is to provide a flotation process with which better effectivities and selectivities are attained than with the usual fatty acid type collectors, avoiding at the same time the frothing problems of the collectors of U.K. Pat. No. 1,355,091.

A further object is to provide collector compositions for carrying out such a process.

Additional objects and advantages will become clear from the following description.

SUMMARY OF THE INVENTION

According to the invention it has been found that mixtures of compounds within a certain sub-group of U.K. Pat. No. 1,355,091 and fatty acid type collectors (oleic acid in any of its commercial forms) show a surprising combination of synergistic properties. Thus, the higher chemical selectivity and effectivity of the compounds of the U.K. patent with respect to oleic acid alone even though the oleic acid is used in a considerable excess, are maintained, whereas on the other hand the foaming tendency is strongly diminished.

Accordingly, the above objects are obtained in accordance with the invention by using collector compositions containing as essential components (1) at least one compound of the formula $RO—(C_xH_{2x}O)_nCH_2COOM$, wherein R is an aliphatic residue of 8–18 carbon atoms or an alkylaryl residue having 6–12 carbon atoms in the alkyl moiety, n has an average value of 0–10 and x has a value of 2 or 3, and M is a monovalent cation, and (2) a usual oleic acid-containing, fatty acid type collector.

If in the acids of the above formula the value of n is higher than 1, the meaning of x in the various groups $C_xH_{2x}O$ can be the same or different.

As is well-known, these ether-carboxylic acids can be prepared starting from an alcohol or phenol of the formula ROH. If the product to be prepared should have an average value of n higher than O, this starting product is first reacted in the usual way with ethylene and/or propylene oxide, whereafter the so obtained product is reacted with a salt of a haloacetic acid. Of course, the compounds wherein n=O, are prepared by reacting the starting compound ROH with the haloacetic acid salt.

The cation has not a large influence on the properties of the entire compound and they can be used in different forms such as the free acid form, the alkali metal salts or ammonium or substituted ammonium salts or amine salts.

As fatty acid collector component one may use commercial grade oleic acid, but also commercial products which contain a more or less considerable amount of oleic acid, such as tall oil or fatty acid obtained from fish oils. As mentioned hereinabove, the replacement of oleic acid by such products is well-known and rather usual.

The two components may be added separately to the flotation process, but preferably they are added as a previously prepared mixture which is much more practical.

Accordingly, this invention also provides a mixture suitable as collector in flotations and containing as essential components the above-defined components (1) and (2).

The two components may be used in amounts which can be varied within relatively wide limits. The ether-carboxylic acid compounds are used preferably in amounts of from 25 to 250 grams per ton of ore, and the oleic acid component can be used in amounts of from 75 to 750 grams per ton of ore. For obtaining the best results the weight ratio between the ether-carboxylic acid component and the oleic acid component should be from 1:15 to 2:1. If lower concentrations of the ether-carboxylic acid and/or lower weight ratios between the ether-carboxylic acid and the oleic acid component are used, the flotation properties of the collector mixtures are intermediate between those of the here described process and normal oleic acid-containing fatty acid type collectors. As a general rule, the weight ratio between ether-carboxylic acid and oleic acid type collector should not be less than 1:30, in order to obtain noticeable improvements.

Dependent on the intended separation, the compositions of this invention may be used at pH-values of about 6–12, i.e. they may be used at any pH-value which occurs in practical situations. In view of the small amount in which the collector mixture is used with respect to the pulp, the final pH will depend largely on the pH-value of the pulp. Thus, the mixture of collectors can be added in salt form to a slurry having a pH below 7 without materially changing this pH-value.

Of course, the ratio between the two components will have some influence on the properties of the final collector mixture. The selectivity will increase with increasing ratios between components (1) and (2), but there are hardly any technical limits to the ratios, and the above stated limits are in fact dictated by reasons of economy.

Of course, the selectivity of component (1) for a particular situation will vary with the exact nature of this component, and this should be taken into account, when choosing the optimum ratio between the two components.

The collector mixtures of the present invention are especially useful for the flotation of minerals containing alkaline earth metal ions, such as apatite, fluorite, magnesite, barite, scheelite and also for the flotation of oxidic copper minerals and oxidic iron minerals.

Due to the presence of component (1) the collector compositions of the present invention are highly insensitive to hard water, and also in this respect there is a synergistic action, because this insensitivity is substantially the same as of the ether-carboxylic acids alone, whereas oleic acid type collectors, as is well known, are highly sensitive to hard water.

The invention is further elucidated by the following examples, which, however, are not intended to limit the invention in any way.

EXAMPLE 1

The original ore was a scheelite-containing copper ore. This ore was subjected to a standard flotation with xanthates and frother at a high pH (11.5), brought about by the addition of lime (CaO) in order to float the copper sulfides. It was desirable to recover scheelite from the tailings of this flotation. The flotation of scheelite constituted a problem, because a good recovery of the scheelite was not possible at the high lime concentrations used.

(a) Experiments with fatty acid from fish oil (predominantly oleic acid) in the pure form or its sodium salts at pH 11.5 did not yield any practical results, even not with 1500 grams per ton of original ore, and this was caused by the high calcium concentration.

(b) By using the compound $C_8H_{17}OCH_2COONa$ as collector in an amount of 250 grams per ton of original ore a recovery of 50% was attained of a material having a content of 20% $WO_3$. However, the use of this collector also did not appear feasible for the commercial practice, because of the phenomenon of over-frothing.

(c) In this experiment a mixture of 200 grams/ton of the compound of part (b) and 100 grams/ton of the fatty acid salt of part a) was used. A recovery of 60% was obtained of a material containing 25% of $WO_3$. However, this time no trouble with over-frothing was experienced, and accordingly a clear synergistic effect was obtained.

EXAMPLE 2

A phosphate ore of magmatic origin was used containing about 7% of $P_2O_5$ with a gangue of mainly silicates and Fe-minerals. A requirement for a good flotation is that the floated material should have a content of at least 36% of $P_2O_5$. In all experiments the pH had been adjusted at 10.2 with the aid of sodium carbonate. Due to this calcium was precipitated which amounts to a dehardening of the water.

(a) 750 grams/ton of a tall oil distillate was used containing principally fatty acids. The recovery was 84% and the floated material contained over 36% of $P_2O_5$.

(b) 150 grams/ton was used of a product having the formula $C_{14}H_{29}—(OC_2H_4)_nOCH_2COONa$, wherein n had an average value of 2. The recovery was 87% of a product containing 33% of $P_2O_5$. In this experiment difficulties were experienced by too much frothing, which resulted in a lower selectivity.

(c) A mixture of 200 grams/ton of the tall oil distillate of part (a) and 100 grams/ton of the compound of part (b) was used as collector. Again a recovery of 87% was obtained with a $P_2O_5$ content of floated material of over 36%, but this time without difficulties caused by too much frothing.

EXAMPLE 3

The original ore contained about 55% of fluorite with as gangue $SiO_2$, $CaCO_3$ and $BaSO_4$; the $BaSO_4$ was previously floated with alkyl sulphate. The remaining material was used for flotation experiments with the aim of recovering fluorite. The requirement for the floated fluorite is that it should be at least 97% pure.

(a) Commercial oleic acid was used in an amount of 250 grams/ton (of the original ore) at a pH of 8, using tannins (500 grams/ton) to depress the calcite. The recovery was 80% and the floated material contained over 97% of fluorite.

(b) This experiment was carried out at a pH of 6 using as collector 100 grams/ton (of original ore) of oleyl-$(OC_2H_4)_nOCH_2COOH$, wherein n has an average value of 6. The recovery was 93% and the floated material contained over 97% of fluorite. The collector was added as the sodium salt. 250 Grams/ton tannin proved to be sufficient to depress the calcite. Remark: The pH-value of 6 was chosen for this experiment, because it is an optimum for the use of this material (the pH was adjusted to the desired value of 6 with $H_2SO_4$). At higher values excessive frothing causes the flotation to be unfeasible for practical purposes. However, the pH of 6 is generally unpractical for using in flotation plants, because almost all flotations, and in this case the previous flotation with alkyl sulphate, are carried out at much higher pH-values.

(c) This experiment was carried out again at pH 8 at a tannin consumption of 500 grams/ton. The collector was a mixture of 90 grams/ton of the oleic acid of part (a) and 30 grams/ton of the oleyl compound of part (b). The recovery was 91.5% and the floated product contained more than 97% of fluorite. Remark: Although the recovery was a fraction lower than in experiment (b) the process of experiment (c) is much more acceptable in actual practice, because no exceptional pH has to be used. Moreover, the cost of the collector mixture of experiment (c) is lower than that used in experiment (b).

EXAMPLE 4

A magnesium ore was used containing about 45% of magnesite with principally $SiO_2$ and dolomite as gangue. The experiments were carried out at a pH which had been adjusted with NaOH at 11.0, using sodium hexametaphosphate as a dolomite depressant. Experiment (a) collector: commercially available tall oil distillate, predominantly containing fatty acids. This distillate was of different quality than that of Example 2. It was used in an amount of 450 grams per ton of ore. The magnesite recovery was 83% and the floated product contained 90% of magnesite, the remainder being predominantly dolomite.

(b) A mixture of 150 grams/ton of the crude tall oil of part (a) and 150 grams/ton of $C_6H_{13}OCH_2COONa$ was used as collector. This time the recovery was 90.5% at a comparable concentrate grade.

EXAMPLE 5

The starting ore contained PbS and ZnS, together with barite as principal economical constituents. The PbS and ZnS were removed by a usual xanthate flotation. The tailing of this flotation contained about 20% barite, the remainder being predominantly iron minerals and silicates. It was desired to recover as much as possible of this barite by flotation. The flotation of the barite was carried out at pH 7.5.

(a) 300 grams/ton of original ore of the same tall oil as in Example 2 (as sodium salt) was used as collector. The recovery of barite was 78% and the floated material contained 96% of barite.

(b) A mixture of 150 grams/ton of the tall oil of part (a) with 30 grams/ton of nonylphenyl-$OCH_2$-COONa was used as collector. The recovery was 87% and the floated product contained 96% of barite.

EXAMPLE 6

The original ore was a copper ore containing both sulphidic and oxidic copper minerals. The copper sulphides were first removed as far as possible by a usual flotation with xanthate. The remaining material contained oxidic copper minerals, intergrown to a large extent with the gangue minerals. In order to recover the oxidic copper minerals at the highest possible grade the material should be crushed again, in order to arrive at the oxidic copper from the gangue. However, it is desirable to carry out this recrushing treatment with as little of the original material as possible, and to this end a flotation is used with the aim to obtain a material of which the particles contain a reasonable percentage of copper so that recrushing of these particles will be worthwhile. The flotation experiments of this example were carried out at pH 8.5.

(a) As collector 650 grams/ton of original ore of commercial sodium oleate was used. The recovery was 57% and the floated material contained 10.9% of Cu.

(b) 300 grams/ton of original ore of dodecylphenyl-$OCH_2COONa$ were used as collector. A copper recovery of 67% was obtained and the floated material contained 9.2% of Cu. However, the use of this collector did not appear quite feasible in practice because of overfrothing.

(c) A mixture of 350 grams/ton of the commercial sodium oleate with 140 grams/ton of the dodecylphenyl compound of part (b) was used as collector. This time a recovery of 70% was attained and the concentrate graded 9.7% of Cu. This time no difficulties by overfrothing were experienced so that this collector mixture is more suitable for actual practice.

EXAMPLE 7

The starting product was an iron ore originally containing about 2% of $P_2O_5$ with as gangue minerals principally silicates and small amounts of $CaCO_3$. The iron constituents were present largely as magnetite and were removed for the greater part magnetically. A flotation was now carried out with the aim of recovering as much as possible apatite. The flotations were carried out at pH 9.0 (adjusted with NaOH).

(a) 275grams/ton of original ore of fish oil fatty acid were used as collector. The recovery was 70% at a grade of 24.5% of $P_2O_5$.

(b) As collector a mixture was used of 140 grams/ton of the fish oil fatty acid of part (a) and 70 grams/ton of $C_8H_{17}OCH_2COONa$ (same product as in Example 1). A recovery of 75% was obtained and the floated product contained 31.0% of $P_2O_5$.

EXAMPLE 8

The ore used for the flotation was a fluorite ore containing about 35% of fluorite with ankerite, calcite and silicates as principal gangue minerals. The flotation experiments were carried out at a pH which had been adjusted at 10.2 with sodium carbonate, whereas dextrin was used as a depressant for gangue minerals.

(a) 800 grams/ton of the same tall oil distillate as used in Example 4 was used as collector. The recovery was 89% and the floated material contained 96.5% of $CaF_2$, 2.1% of carbonates and 1.0% of $SiO_2$.

(b) A mixture of 200 grams/ton of the tall oil distillate of part (a) and 200 grams/ton of $C_8H_{17}O$-$CH_2$-COONa was used as collector. The recovery was 91% and the floated material contained 97.8% of $CaF_2$, 1.3% of carbonates and 0.7% of $SiO_2$.

EXAMPLE 9

A fluorite ore was used containing about 65% of fluorite with as gangue minerals quartz and mica. The flotation experiments were carried out at a pH-value of 8.5.

(a) 425 grams/ton of the same tall oil distillate as in Examples 4 and 8 were used as collector. The recovery was 94% and the floated product contained 94% of fluorite. It should be remarked that this is a too low grade which is caused by the mica in the gangue.

(b) A mixture of 150 grams/ton of the tall oil distillate of part (a) and 75 grams/ton of myristyl-$(OC_2H_4)_n$-$OCH_2COONa$, wherein n has an average value of 2, was used as collector. This time the recovery was 95% and the floated material contained over 97% of fluorite.

EXAMPLE 10

The starting product was a copper ore containing both sulphidic and oxidic copper minerals. The sulphidic copper minerals were first removed by a standard flotation with xanthates. The aim of the present experiments was to recover as much as possible of the oxidic copper minerals. The experiments were carried out at a pH which had been adjusted at 10.5 with NaOH.

(a) The same tall oil distillate as in Examples 4, 8 and 9 was used as collector in an amount of 500 grams/ton of original ore. The recovery was 65%, and the floated material contained 25% of Cu.

(b) A mixture of 300 grams/ton of original ore of the above tall oil distillate with 100 grams/ton of original ore of oleyl-$(OC_2H_4)_nOCH_2COONa$, wherein n has an average value of 6, was used as collector. The floated product again contained 25% of Cu, but this time the recovery was 78%.

EXAMPLE 11

The original ore contained both barite and fluorite as valuable constituents. First the barite was floated with an alkyl sulphate type collector. The tailings of this flotation contained about 25% of fluorite with $SiO_2$ as the principal gangue mineral. It was desired to recover the fluorite in a purity of at least 97% (according to usual specifications).

(a) 500 grams/ton of ore of a commercial available twice distilled tall oil fraction, predominantly containing fatty acids, was used as a collector at pH 8. The recovery was 85% and the floated product contained over 97% of fluorite.

(b) 125 grams/ton of original ore of hexylphenyl-O-$CH_2COOH$ was used as the collector at pH 6 (adjusted with $H_2SO_4$). This pH had been chosen after previous experiments had shown that this was the optimum pH for this flotation. The collector was added as the sodium salt to the acidic pulp. The recovery was 93%, and the floated product contained again over 97% of fluorite. Although the recovery has increased, the pH of 6 which, as stated already hereinabove, is rather exceptional in flotation practice, means a serious drawback for actual application.

(c) A mixture of 200 grams/ton of original ore of the tall oil distillate of part (a) and 80 grams/ton of original ore of the compound of part (b) was used as collector, this time at pH 8 again. The same recovery was attained as in part (b), i.e. 93%, and the floated product contained over 97% of fluorite.

EXAMPLE 12

A fluorite ore was used containing about 40% of fluorite which was intimately intergrown with the $SiO_2$ gangue. Consequently, the ore was ground to a relatively fine size distribution. The flotation experiments were carried out at a pH which had been adjusted at 10 with sodium hydroxide.

(a) 475 grams/ton of ore of commercial sodium oleate were used as collector. The recovery was 79%, and the floated material contained over 97% of fluorite. Losses of fluorspar were mainly due to very fine particles.

(b) A mixture of 325 grams/ton of the sodium oleate with 125 grams/ton of nonyl-phenyl-$OCH_2$-COONa was used as collector. The recovery this time was 89% and the floated product again contained over 97% of fluorite.

EXAMPLE 13

The original starting product was a barite-containing ore grading about 30% of barite. According to a known method the crushed ore was upgraded by a dense medium separation (with ferro silicon slurry), wherein the light silicates were separated for the greater part. In this way a concentration of the ore to about 80% of barite was obtained. This preconcentrated ore was used for the flotation experiments. These experiments were carried out at a pH which had been adjusted at 10.5 with NaOH.

(a) 750 grams/ton of original ore of commercial oleic were used as collector. The recovery was 95% and the floated material contained 96% of barite.

(b) 300 grams/ton of original ore of dodecylphenyl-$(OC_2H_4)_nOCH_2COOH$, wherein n has an average value of 10, were used as the collector. The recovery was 97.5%, and the barite content of the floated material was 95%. It appeared that this collector was not feasible for practical purposes, because of excessive frothing, resulting into lower grades by the mechanically floated gangue particles.

(c) A mixture of 125 grams/ton of original ore of the oleic acid and 250 grams/ton of original ore of the dodecylphenyl compound of part (b) was used as collector. The recovery was 96% and the floated material contained 97.5% of barite. This time no excessive frothing occurred.

EXAMPLE 14

A fluorite ore was used containing about 70% of fluorite with as gangue minerals principally $SiO_2$ with small percentages of $CaCO_3$ and $CaSO_4$. The flotation experiments were carried out at pH 8.

(a) Commercial oleic acid in an amount of 1000 grams/ton of ore was used as the collector. The recovery was 93% and the floated material contained more than the required 97% of fluorite.

(b) A mixture of 275 grams/ton of ore of the oleic acid with 100 grams/ton of ore of dodecylphenyl-$(OC_2H_4)_nOCH_2COOH$, wherein n has an average value of 10, was used as collector. At this much lower collector consumption again a recovery of 93% was obtained, and the floated material again contained over 97% of fluorite.

EXAMPLE 15

A sedimentary phosphatic ore containing 18% of $P_2O_5$ was floated after desliming by conventional methods at pH 10 with NaOH, using a mixture of petroleum sulfonate and fatty acids as collectors. The rougher concentrate was cleaned and recleaned.

(a) As the fatty acid collector 1000 grams/ton of flotation feed of a crude tall oil was used. A concentrate grading 31.5% of $P_2O_5$ was obtained at a flotation recovery of 89%.

(b) 500 grams/ton of crude tall oil and 100 grams/ton of $C_{14}[(OC_3H_6)\text{-}(OC_2H_4)]_n\text{-}OCH_2COOH$, wherein n has an average value of 4, consisting of 2 units of propylene oxide and 2 units of ethylene oxide, were used as collector. At this reduced collector consumption a high recovery of 93% was obtained and the grade even amounted to 32.4% of $P_2O_5$.

(c) 500 grams/ton of crude tall oil and 20 grams/ton of the compound described under (b) resulted in a flotation recovery of 89% at a grade of 32.1%. Remark: In practice, the most desired collector recipe strongly depends on prices of phosphate concentrates at different grades and collector costs.

Evidently, various modifications can be made in the light of the discussion and disclosure hereinabove without departing from the scope thereof.

What we claim is:

1. In a process for the flotation of minerals chosen from the group consisting of minerals containing alkaline earth metal ions and oxidic copper minerals and oxidic iron minerals the improvement consisting of using as a collector a composition consisting essentially of (1) at least one compound of the formula RO-$(C_xH_{2x}O)_nCH_2COOM$, wherein R is a residue chosen from the group of aliphatic residues of 8–18 carbon atoms and alkylaryl residues having 6–12 carbon atoms in the alkyl moiety, n is a number having an average value of 0–10 and x is a number having one of the values 2 and 3, and M is a monovalent cation, and (2) a usual, oleic acid-containing, fatty acid type collector wherein the ratio between component (1) and component (2) is at least 1:30.

2. The process of claim 1, wherein the ratio between component (1) and component (2) is within the range of from 1:5 to 2:1.

3. Collector composition for the flotation of minerals chosen from the group consisting of minerals containing alkaline earth metal ions and oxidic copper minerals and oxidic iron minerals, consisting essentially of (1) at least one compound of the formula $RO\text{-}(C_xH_{2x}O)_nCH_2\text{-}COOM$, wherein R is a residue chosen from the group of aliphatic residues of 8–18 carbon atoms and alkylaryl residues having 6–12 carbon atoms in the alkyl moiety, n is a number having an average value of 0–10, x is one of the numbers 2 and 3, and M is a monovalent cation, and (2) a usual, oleic acid-containing, carboxylic acid type collector wherein the ratio between component (1) and component (2) is at least 1:30.

4. The composition of claim 3, wherein the ratio between component (1) and component (2) is within the range of from 1:5 to 2:1.

* * * * *